US006478699B1

(12) United States Patent
Fairweather

(10) Patent No.: US 6,478,699 B1
(45) Date of Patent: Nov. 12, 2002

(54) TETHERED PRACTICE APPARATUS

(76) Inventor: Kaitlin Joyce Fairweather, 19 River Rd., Amherst, NH (US) 03031

( * ) Notice: Subject to any disclaimer, the term of this patent is extended or adjusted under 35 U.S.C. 154(b) by 0 days.

(21) Appl. No.: 09/595,960

(22) Filed: Jun. 19, 2000

(51) Int. Cl.[7] ..... A63B 69/00; A63F 7/20
(52) U.S. Cl. ..... 473/430; 473/423; 273/317.8
(58) Field of Search ..... 273/317.8; 473/423, 473/424, 425, 426, 427, 428, 430, 506, 507, 509, 508, 510, 515, 575, 576; 482/87, 89; 87/4, 9, 10; 150/118, 129, 130, 123, 126, 128

(56) References Cited

U.S. PATENT DOCUMENTS

| | | | | | |
|---|---|---|---|---|---|
| 291,447 | A | * | 1/1884 | Wheeler | 150/118 |
| 708,573 | A | | 9/1902 | Miles | |
| 731,378 | A | * | 6/1903 | Luther | 150/118 |
| 931,627 | A | * | 8/1909 | Lazarovich-Hrebelianovich | 150/118 |
| 2,635,664 | A | * | 4/1953 | Cohen | 150/129 |
| 4,071,239 | A | | 1/1978 | Ferguson | |
| 4,247,117 | A | * | 1/1981 | Reichert | 473/424 |
| 5,083,797 | A | * | 1/1992 | Vartija et al. | 473/424 |
| 5,088,732 | A | | 2/1992 | Kim | |
| 5,094,462 | A | * | 3/1992 | Boyle et al. | 473/576 |
| 5,443,576 | A | * | 8/1995 | Hauter | 473/424 |
| 5,542,661 | A | | 8/1996 | Gregan | |
| 5,586,760 | A | * | 12/1996 | Hauter | 473/424 |
| 5,611,539 | A | | 3/1997 | Watterson et al. | |
| 5,792,014 | A | * | 8/1998 | Brown | 473/430 |
| 5,957,789 | A | * | 9/1999 | Ainscough et al. | 473/423 |
| 6,062,993 | A | * | 5/2000 | Rodriguez | 473/424 |
| 6,168,539 | B1 | * | 1/2001 | Maina | 473/424 |

* cited by examiner

*Primary Examiner*—Paul T. Sewell
*Assistant Examiner*—Alvin A. Hunter
(74) *Attorney, Agent, or Firm*—Altera Law Group, LLC

(57) ABSTRACT

A training device intended for use with a ball or object, which is to be retained after striking or throwing, is disclosed. The device employs a retaining pouch which is capable of easily receiving a ball without modification or damage to the ball, yet securely retain same within the pouch and provide sufficient strength to prevent the ball from escaping the pouch during maximal acceleration. The pouch has a plurality of apertures which allow weaving of the tether therethrough and when drawn tight, prevent escape of the ball through the, now closed, end of the pouch. The ball can be easily exchanged by simply releasing the tether and opening the pouch.

9 Claims, 9 Drawing Sheets

TETHERED PRACTICE APPARATUS

FIELD OF THE INVENTION

This invention relates to a device for practicing sports which involve a ball or other object, more particularly a ball which is accelerated by a racquet or the like, or thrown.

BACKGROUND OF THE INVENTION

There are numerous tethered ball apparatuses in the prior art. They are characterized generally by having a ball attached to a tether, which is in turn attached to a racquet or other fixed device such as a pole. All these prior devices have in some way dealt with the problem of how to attach the tether to the ball.

For example, in U.S. Pat. No. 5,542,661 to Gregan, the attachment is accomplished by putting an eye at 42 on the ball (FIG. 9). U.S. Pat. No. 4,071,239 to Ferguson uses a plurality of bands as shown in FIG. 5. U.S. Pat. No. 5,611,539 to Watterson et. al. which uses a net structure fixed with tether as shown in FIG. 2. U.S. Pat. No. 708,573 to Miles likewise shows a net structure with loops that attach thereto.

The problem in the prior art has been that the various means for attaching the ball to the tether have either been damaging to the ball or complex or difficult to manufacture and assemble. The present invention overcomes these prior art problems by providing a simple way to immobilize the ball within an enclosure, which in turn is attached to a tether. The ball is not damaged in any way and can be easily removed for use without the training apparatus. Furthermore, the user is free to select a ball (or other non-round object) of their choice to simulate different practice conditions.

Thus, the present invention solves the problems of needing to modify the practice ball, interchangeability of the ball, cost reduction, simplicity and has the ability to handle odd shaped and non-round objects as easily as balls.

DETAILED DESCRIPTION

Figure 1:
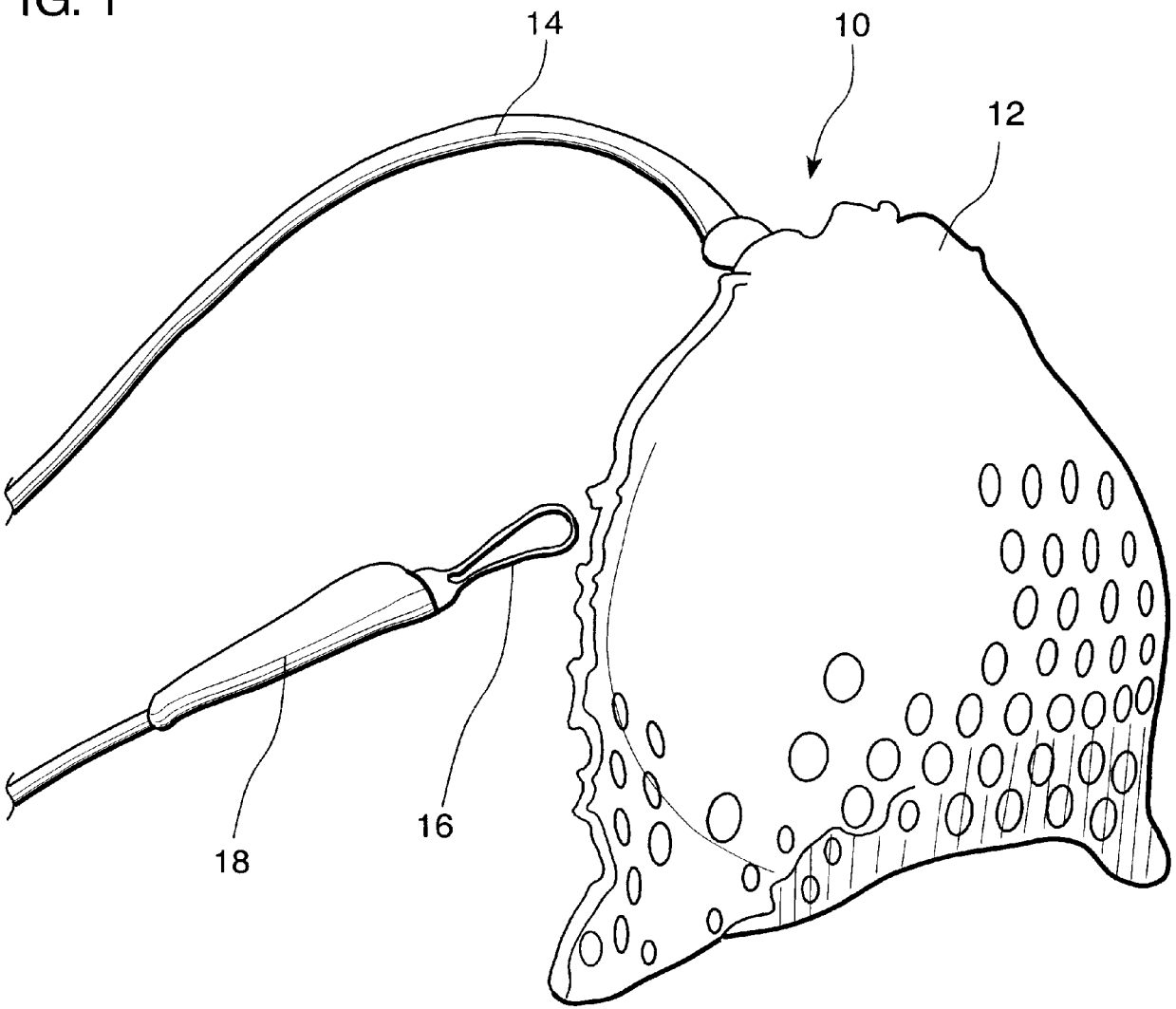
FIG. 1 is a perspective view showing the tether in the encapsulating pouch.

Referring initially to FIG. 1, the invention is a tethered practice device 10. It is formed from an encapsulating bag or pouch 12 from which a tether 14 extends terminating in a hook or other anchoring device 16. The hook is attached to the tether at a clasp or other connecting point 18, which can be formed by a knot, crimp or other mechanical closure.

Within the encapsulating bag 12 is a ball 20. The nature of the ball or non-round object 20 will be determined by the type of sport for which this invention is intended. In the preferred embodiment, this device is intended as a Lacrosse trainer in which case a Lacrosse ball would be installed within the encapsulating bag 12. Hook 16 would then be looped through the webbing of the Lacrosse stick (not shown) and clipped either to the tether or webbing on the stick. For other sports, it is understood that different types of clips or attachment means could be provided.

The elastic member 14 can be a standard elastic material but has to be selected on the basis of the weight of the ball 20 and the speed to which the stick or mallet will accelerate same. In the case of Lacrosse, an elastic member of about 2–3 mm is sufficient.

Figure 2:
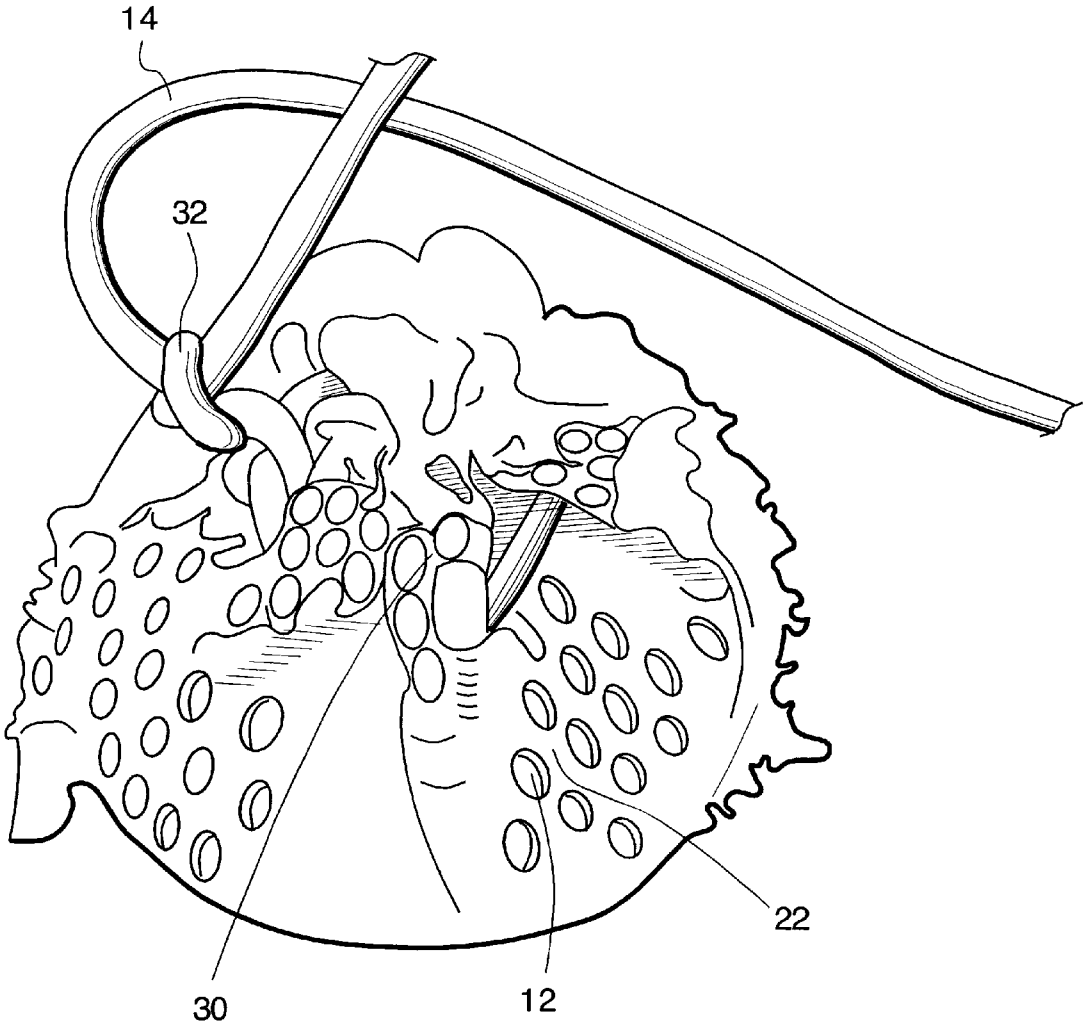
FIG. 2 is a figure like FIG. 1 except taken generally from the top.
Figure 3:
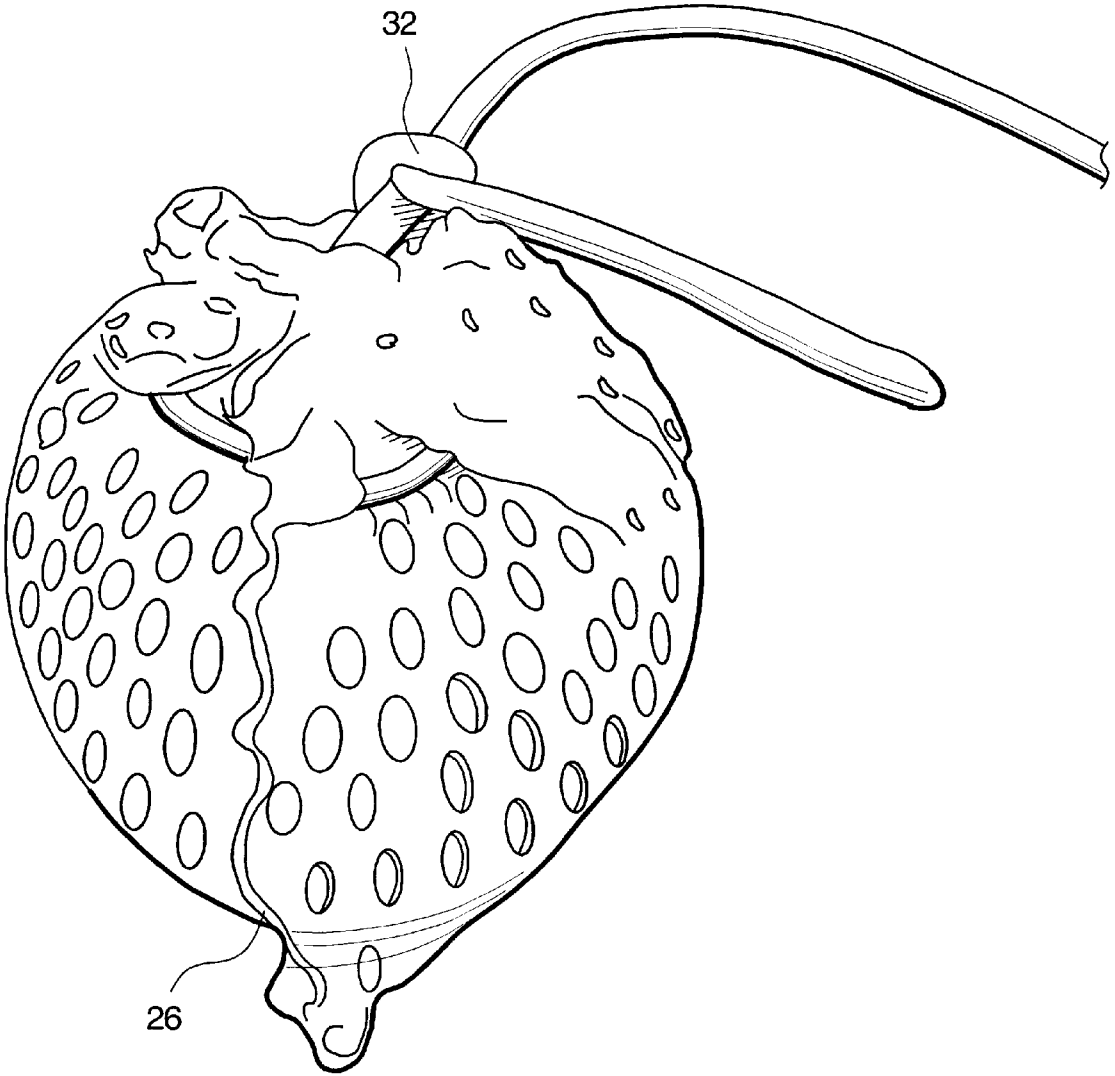
FIG. 3 is view like FIG. 2 taken as a perspective.
Figure 7:
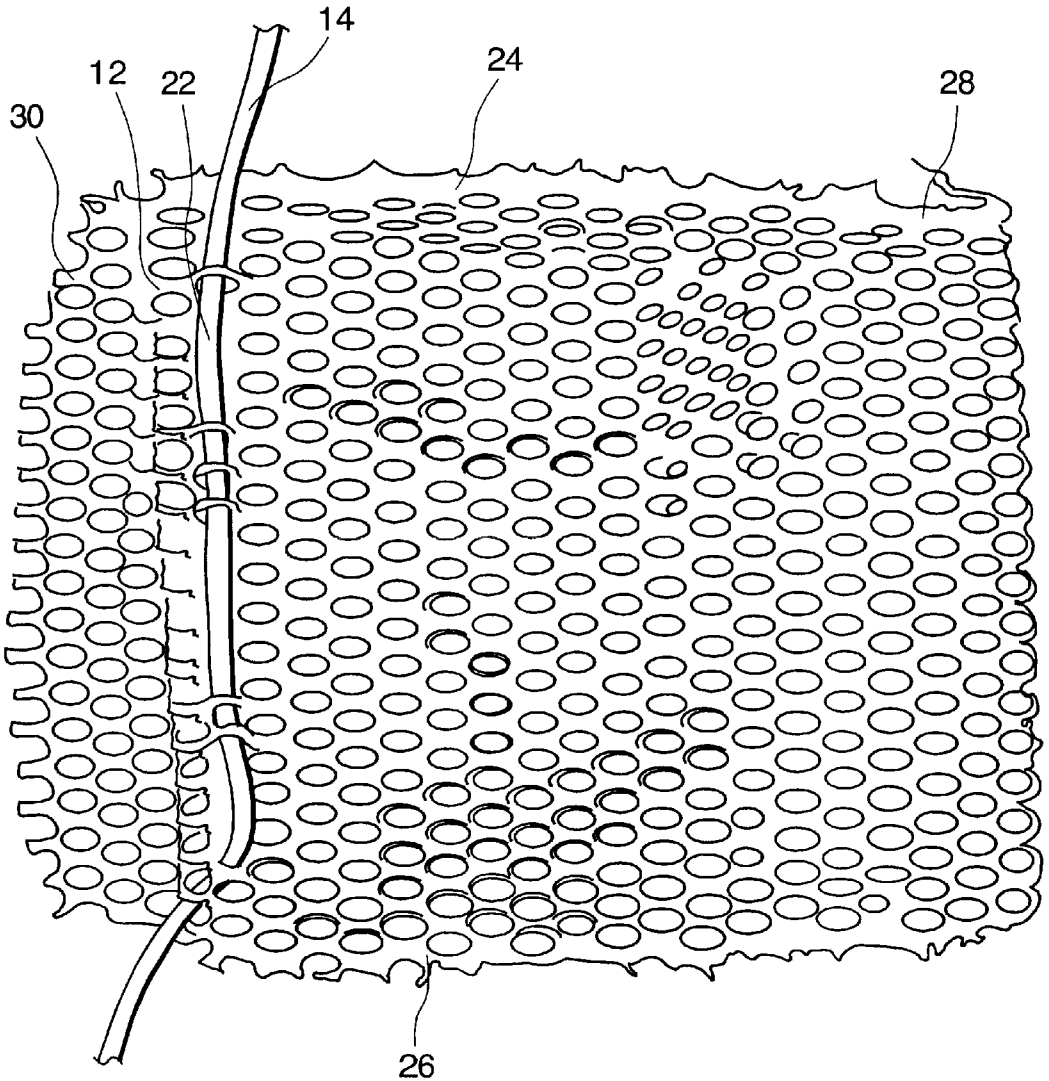
FIG. 7 is a view of the encapsulating bag with the tether partially looped or woven therethrough.
Figure 8:
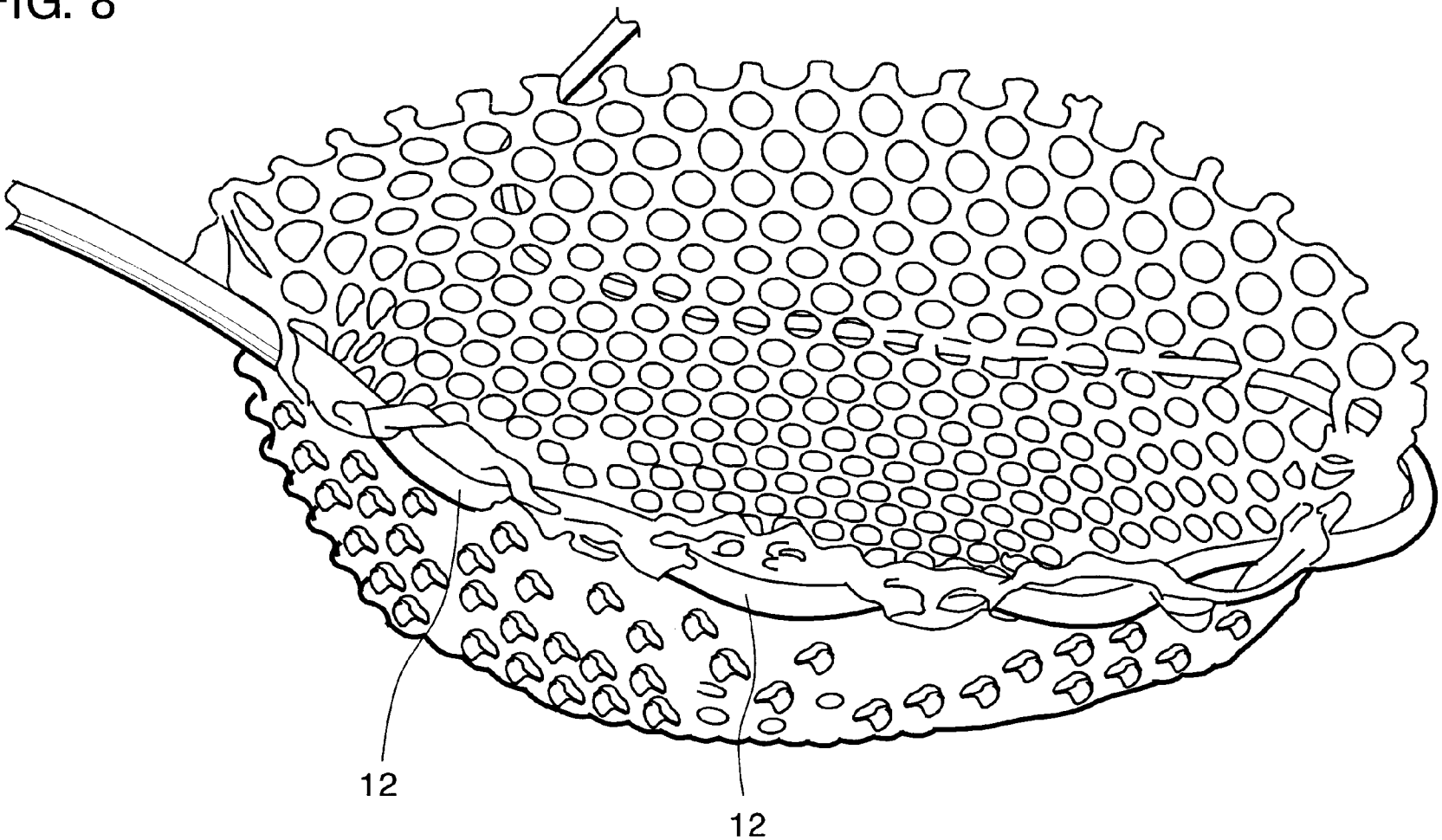
FIG. 8 is a view like FIG. 7 but taken from a top perspective.
Figure 9:
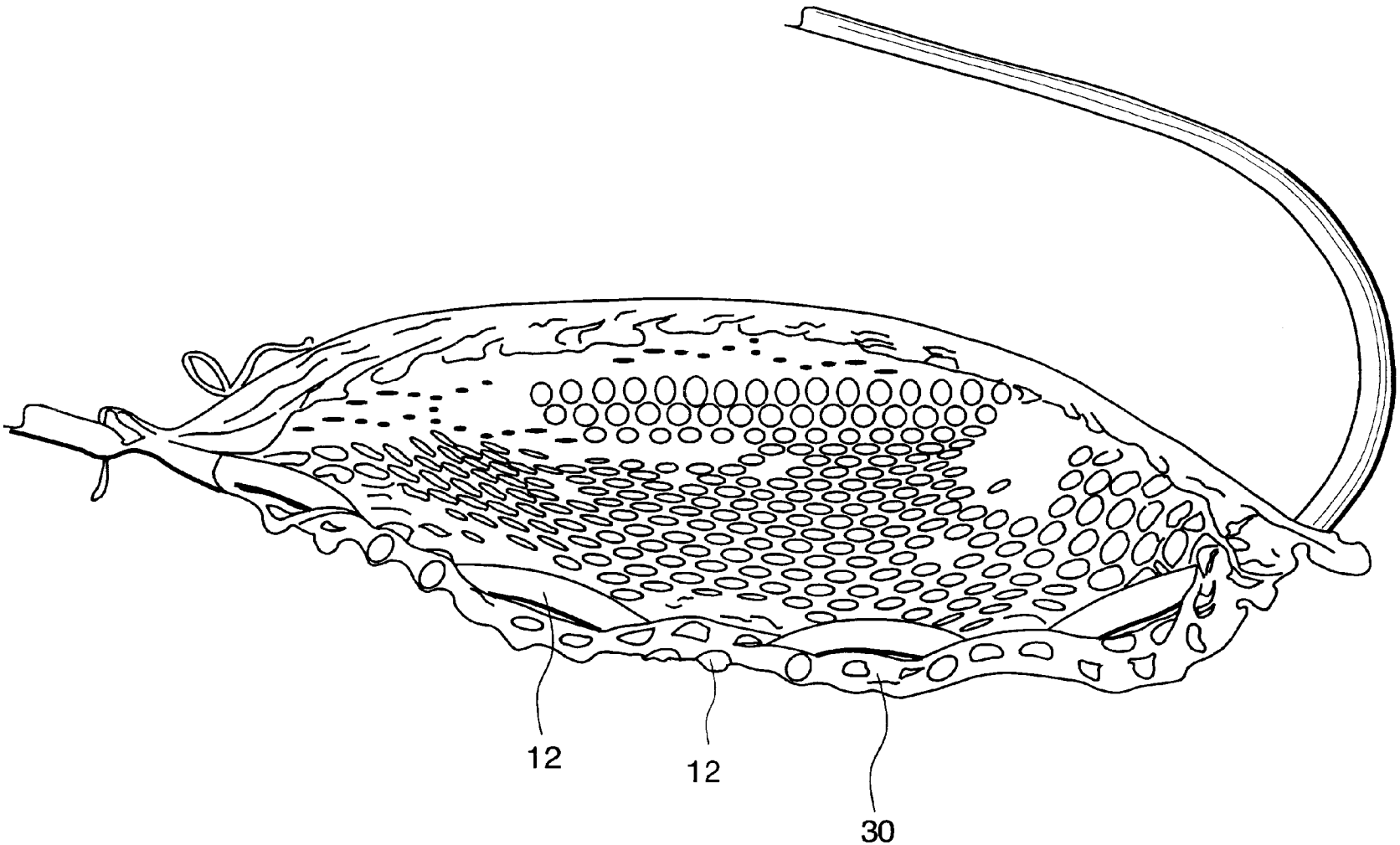
FIG. 9 is a view like FIG. 8 but taken from the top.

FIG. 2 shows the preferred attachment of the elastic member 14 to the encapsulating bag 12. The other FIGS. (3–9) provide additional views, but are somewhat duplicative. In the preferred embodiment, the encapsulating bag 12 is formed of a netting with a plurality of apertures 22. As shown in FIG. 7, the elastic member is woven through various holes in the netting to provide a "sewn" look. The bag material need not be a mesh or web throughout. It only needs to have apertures at its open end to allow for weaving of the free end of the tether through some of the apertures. The web is then drawn tight to gather the web at its open end thereby retaining the ball.

It is however advantageous to use a webbed material as it will interfere the least with the aerodynamic characteristics of the object.

The selection of webbing is critical in the survivability of the device. Early experiments found that the web material needs to be selected to be strong enough to not tear or shred when the tether and pouch are maximally distended by the ball's velocity being rapidly brought to zero when the elastic limit of the tether is reached. Experimentation has determined that the webbing is best made from a multi-filament material, preferably reinforced or perhaps coated for maximum shear resistance.

The choice of material for the material for the encapsulating bag 12 is thus important and its selection depends on the weight of the ball and the acceleration thereof. In the case of Lacrosse, it has been found that reinforced nylon mesh of a type made by Arden Company's of Southfield Mich., USA part number M6009, is approximately the right size and strength for Lacrosse usage. This nylon is characterized by the mesh being a woven material which is preferably a lattice work of ropes which are intertwined to form loops. The Arden product is intended for use as a scouring pad and had good abrasion resistance and permits manufacture at a low cost.

The preferred embodiment therefore employs a scouring pad material which has abrasion resistance to the thread (ropes) of which it is made. This abrasion resistance provides an additional strength against shredding onto the strain of impact and when the tether is fully extended and thereby putting maximum pressure on the apertures.

The encapsulating bag itself is shown clearest in FIG. 7 and can be made in a number of different ways. In the preferred embodiment, flat sheets of netting material sized appropriately for the intended ball type are folded over to create an unseamed bottom end and sewn, seamed or otherwise joined along there peripheral edges 24 and 26. The seams do not extend all the way to the free end. Rather, the seams end short of the free end, leaving a portion unseamed to create free ends which can be folded over for double reinforcement at the point of contact with the tether. The bottom edge of 28 is preferably seamless and has merely a fold to provide addition strength. Before tether 14 is woven through apertures 22, it is preferable to fold a flap 30 into the inside of the pouch formed by the encapsulating bag (although the outside would function as well). This provides a point of double strength where the tether 14 is woven through the apertures.

Figure 4:
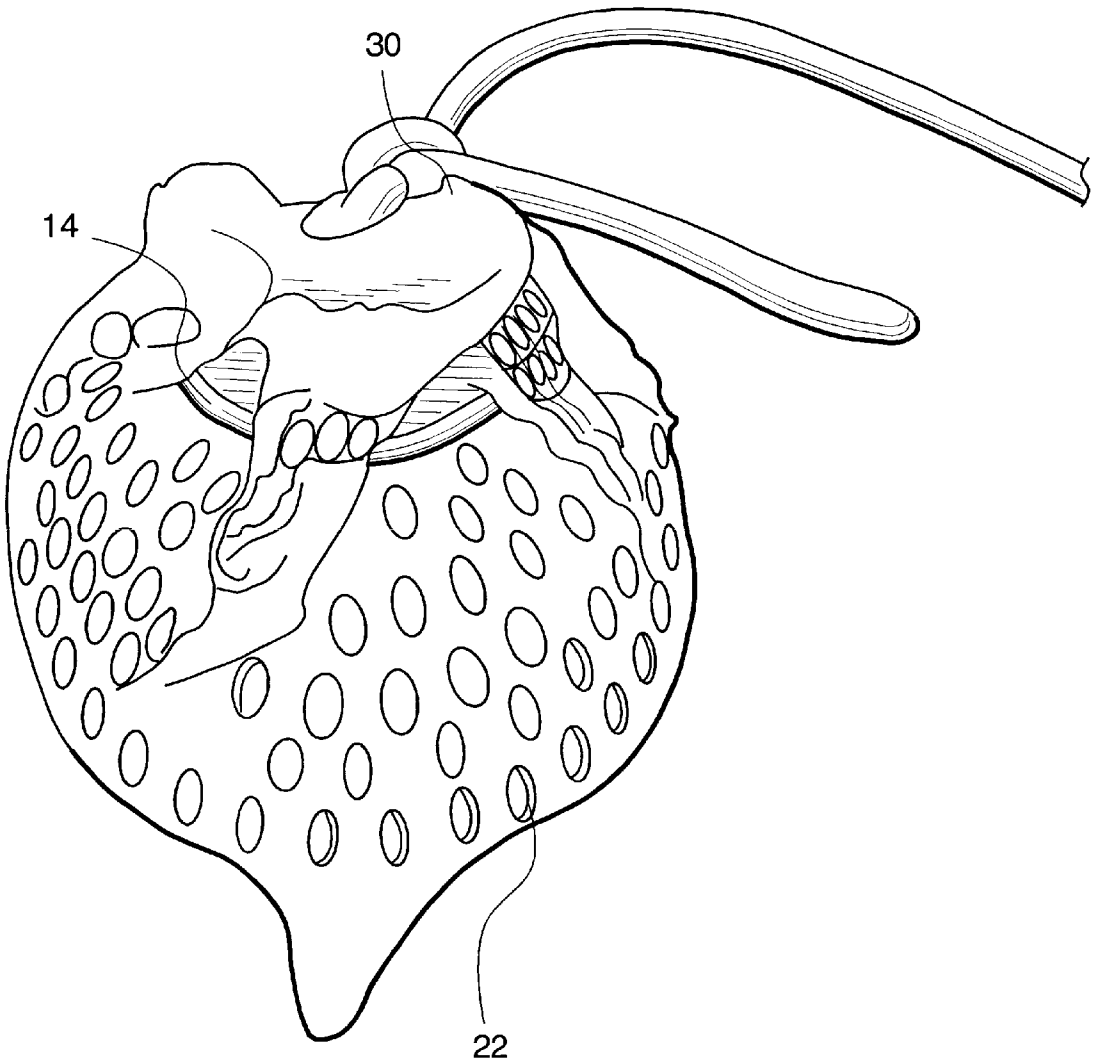
FIG. 4 is a view like FIG. 3 taken from an alternate perspective.
Figure 5:
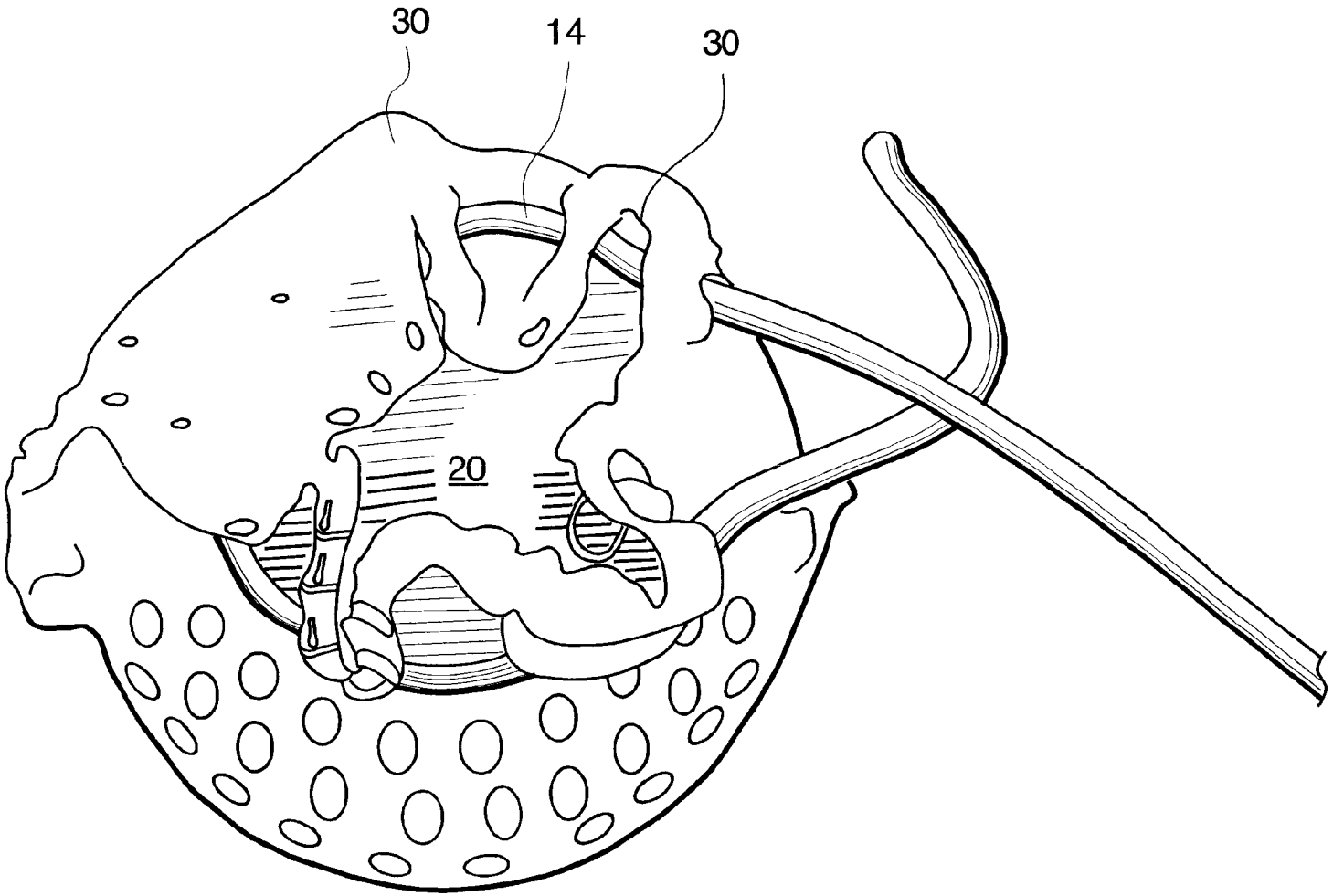
FIG. 5 is a view like FIG. 3 with the tether is unknotted and the encapsulating bag is opened in part.
Figure 6:
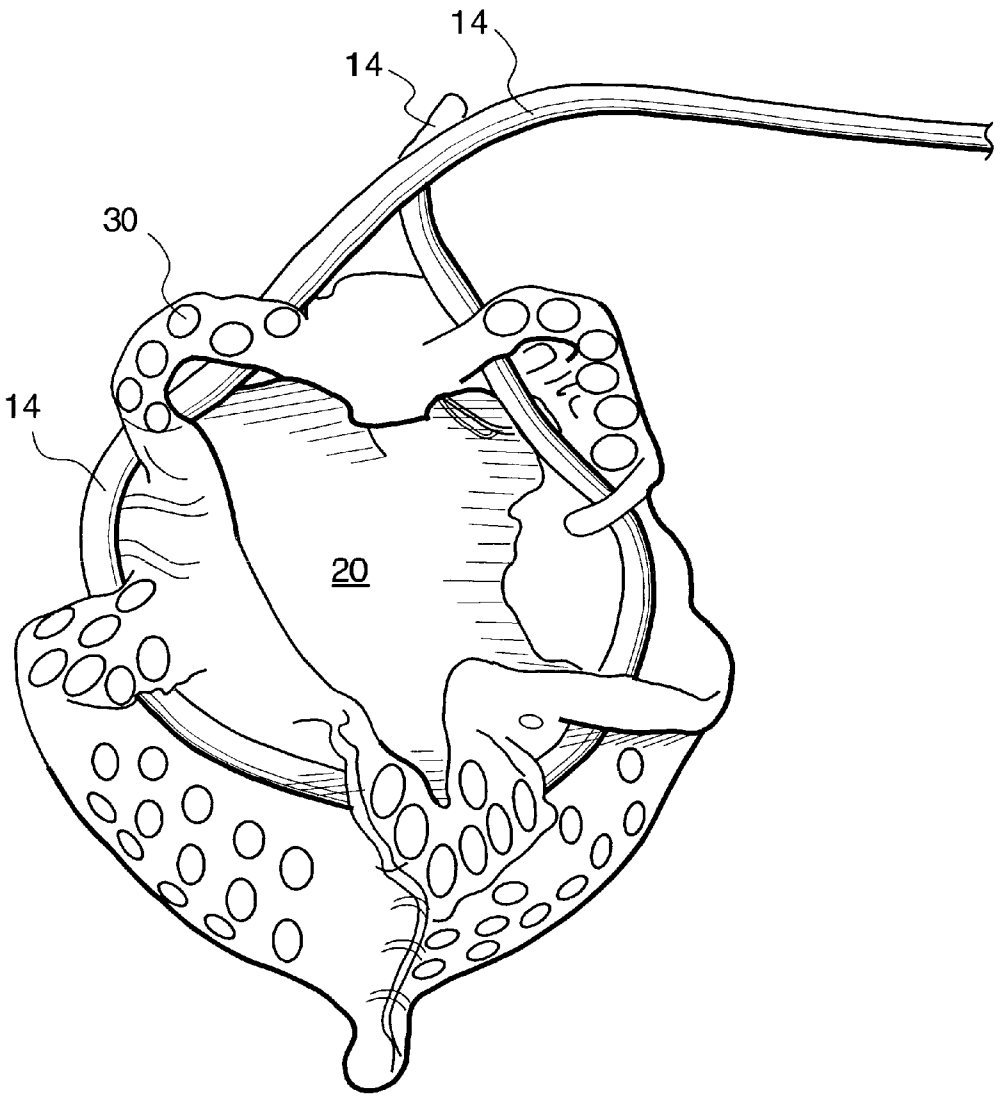
FIG. 6 is a view like FIG. 5 taken from the top.

In the preferred embodiment a double bag (i.e. 2 identical encapsulating bags 12, one within the other), is provided to enhance the strength of the encapsulating bag. FIG. 4 shows apertures 22 misaligned making it clear that 2 bags are employed in this configuration.

In FIG. 7, it will be understood therefore that flap 30 which is folded over for each bag will result in the tether 14 being woven through four layers of web material for addition strength in this configuration.

It is also understood that to create the folded flap portion in the encapsulating bag 12, that joints 24 and 26 do not extend to the top end of the bag or that the joints are cut to allow for the folding of the portions.

Ball 20 is preferably encapsulated within the bag by the "drawstring" effect of tether 14 through apertures 22 as shown in the various figures.

Finally, in FIG. 2, tether 14 has a knot 32 which secures the tether from flying out under stress. Various forms of knots would be appropriate as well as crimping and other means for preventing the tether from slipping out.

There are, however, other ways to achieve the desired result of retaining the tether. It does not have to be knotted to the portion of the tether exiting the pouch. It can be knotted or modified (such a crimping, folding or attaching a band device) to simply enlarge its end portion. This will result in a bulge on the end of the tether too large to slip through the apertures.

The advantage of using a knot 32 over some other more permanent crimp is it is possible to change the ball quickly and easily and the tether does not have to be cut or re-crimped.

It can be appreciated that there a multiple embodiments which could be employed in making this invention and that various modifications and revisions are possible within scope of this invention and are intended to be considered within the scope of the claims which follow. It should also be appreciated that this device can be used on any type of ball related game as an exercise or practice apparatus and it not limited to round balls.

I claim:

1. A sports training apparatus for use with a ball or other sports object comprising:

an anchor;

a tether attached at one end thereof;

an encapsulating pouch, having an open end forming a circumference of webbed material, said webbed material including a series of adjacent apertures, wherein the other end of said tether is woven through a first aperture, then skipping at least one adjacent aperture, then through a subsequent aperture, repeatedly around the circumference of the said open end, and when drawn together, close said opening to prevent separation of the object during rapid acceleration of said pouch, and wherein said pouch is formed from a flexible planar material, folded over to form a seamless bottom end, an open end and two sides joined adjacent the bottom end, said joined sides extending from the bottom end toward the open end but not reaching said open end, to allow the unjoined portion to be folded over, thereby creating a double layered portion of the pouch through which said tether is woven.

2. An apparatus according to claim 1, wherein said tether is drawn tightly through said apertures, to removable close said open end and there by capture said object within said pouch.

3. An apparatus according to claim 2 wherein said tether is knotted to itself at said apertures.

4. An apparatus according to claim 2 wherein said tether is restrained from being removed from said apertures, by mere tension on the tether from the anchor end.

5. An encapsulating pouch and tether for use in connection with a sport training apparatus, comprising a tether with a free end, said pouch comprising, a flexible webbed material having a plurality of adjacent apertures near its open end, said open end having flap portions being folded over to create a double layer of webbed material at open end, said free end of said tether being woven through at least some, but not all of said adjacent apertures around the circumference of the open end, said free end of said tether being formed to have a diameter greater than said apertures, so that, when said tether is tensioned, it will tend to gather the open end together and seal the object therewithin, and wherein said pouch is formed from a flexible planar material, folded over to form a seamless bottom end, an open end and two seamed sides adjacent the bottom end, said seams extending from the bottom end toward the open end but not all the way said open end, to allow the unseamed portion to be folded over, thereby creating a double layered portion of the pouch.

6. A pouch according to claim 5 wherein said folded portion is folded inwardly toward the interior of the pouch thereby maintaining an unbroken outer surface of the pouch adjacent the tether.

7. A pouch according to claim 6 wherein said pouch is made of a webbed material.

8. A pouch according to claim 7 wherein said webbed material is a mesh of sufficient tensile strength so that it will not rip when said pouch and tether are maximally tensioned with respect to each other during use of the training apparatus.

9. A sports training apparatus for use with a ball or other sports object comprising:

an anchor;

a tether attached at one end thereof;

an encapsulating pouch, having an open end forming a circumference of webbed material, a folded over portion at its open end to form a double layered periphery, said webbed material including a plurality of apertures, wherein the other end of said tether is woven a plurality of said apertures around the circumference of the said open end skipping at least every other aperture, and when drawn together, close said opening to prevent separation of the object during rapid acceleration of said pouch.

* * * * *